US012565786B2

(12) United States Patent
Zhang

(10) Patent No.: US 12,565,786 B2
(45) Date of Patent: Mar. 3, 2026

(54) POOL BRUSH ASSEMBLY WITH REPLACEABLE HANDLE AND BRUSH HEAD ARRANGEMENT

(71) Applicant: Ningbo Bonny E-Home Co., Ltd., Ningbo (CN)

(72) Inventor: Hongchuan Zhang, Ningbo (CN)

(73) Assignee: Ningbo Bonny E-Home Co., Ltd., Ningbo (CN)

( * ) Notice: Subject to any disclaimer, the term of this patent is extended or adjusted under 35 U.S.C. 154(b) by 311 days.

(21) Appl. No.: 18/131,078

(22) Filed: Apr. 5, 2023

(65) Prior Publication Data

US 2024/0337124 A1 Oct. 10, 2024

(51) Int. Cl.

| | |
|---|---|
| ***E04H 4/16*** | (2006.01) |
| ***A46B 5/00*** | (2006.01) |
| ***A46B 9/02*** | (2006.01) |

(52) U.S. Cl.

CPC ..... *E04H 4/1609* (2013.01); *A46B 5/0095* (2013.01); *A46B 9/028* (2013.01)

(58) Field of Classification Search

CPC ..... E04H 4/1609; E04H 4/16; A46N 5/0095; A46N 7/04; A46N 9/02

See application file for complete search history.

(56) References Cited

U.S. PATENT DOCUMENTS

| | | | | |
|---|---|---|---|---|
| 3,134,129 | A * | 5/1964 | Allen | A47L 13/22 15/418 |
| 4,447,927 | A * | 5/1984 | Malless, Jr. | E04D 13/0765 401/137 |
| 5,305,882 | A * | 4/1994 | Kaplan | A46B 5/005 206/349 |
| 7,000,281 | B1 * | 2/2006 | Morad | A46B 7/04 15/159.1 |
| 2014/0123422 | A1 * | 5/2014 | Boyd | E04H 4/1609 15/160 |

* cited by examiner

*Primary Examiner* — Shay Karls
(74) *Attorney, Agent, or Firm* — David & Raymond Patent Firm; Raymond Y Chan

(57) ABSTRACT

A pool brush assembly includes a main brush body and a replaceable handle and brush head arrangement. The main brush body includes an elongated brush frame having a first end and a second end and a plurality of brush elements outwardly extended from a brushing side thereof. The replaceable handle and brush head arrangement includes a connecting dock provided between the first end and the second end, a handle frame detachably connected to the connecting dock for detachably connecting with a handle bar, at least one end connector configured at one of the first end and the second end of the main brush body, and at least one brush head configured to be detachably connected to the at least one end connector, wherein the at one brush head comprises a connector joint and a plurality of end brush elements outwardly extended therefrom.

16 Claims, 7 Drawing Sheets

POOL BRUSH ASSEMBLY WITH REPLACEABLE HANDLE AND BRUSH HEAD ARRANGEMENT

NOTICE OF COPYRIGHT

A portion of the disclosure of this patent document contains material which is subject to copyright protection. The copyright owner has no objection to any reproduction by anyone of the patent disclosure, as it appears in the United States Patent and Trademark Office patent files or records, but otherwise reserves all copyright rights whatsoever.

BACKGROUND OF THE PRESENT INVENTION

Field of Invention

The present invention relates to pool brush, and more particularly to a pool brush assembly with replaceable handle and brush head arrangement, which allows the user to assemble a pool brush with types of brush head and handle to form a brush body with different lengths to accommodate the walls, corners and tile types of various kinds and sizes of the pool and to detach the round end brush heads from the brush body to be used independently with a handle as bowl brush or cylinder brush for smaller, curved and tubular surface.

Description of Related Arts

U.S. Design patent application Ser. No. 29/835,842 discloses a pool brush, as shown in FIG. 1, comprising a brush body 1P and a handle frame 2P adapted to be detachably connected with a handlebar, wherein the brush body has an elongated main bristle brush 11P and two round end bristle brushes 12P provided at two end of the main bristle brush 11P respectively, such that the pool brush is allowed to brush and clean a pool surface with the main bristle brush 11P and the corners, edges and steps with the round end bristle brushes 12P. Therefore, the user has no need to carry a conventional pool brush as shown in FIG. 2A, and a round head brush as shown in FIG. 2B but simply carries the single pool brush as shown in FIG. 1 for the pool cleaning work.

To a regular rectangular swimming pool, the pool brush in FIG. 1 is good enough to brush the surfaces with the main bristle brush 11P and the four right angle corners with the end bristle brushes 12P. However, for swimming pools with irregular shapes, spa pools, fountain pools, landscape pools, fish pools, and the like, irregular corners, gaps, steps, clearances and uneven surfaces are often formed that the conventional pool brush is not configured to efficiently brush and clean such non-flat areas with the elongated body and additional brushes such as round head brushes with different shapes and types of bristle are required to carry and use too.

SUMMARY OF THE PRESENT INVENTION

The invention is advantageous in that it provides a pool brush assembly configured to detachably connect with a replaceable handle and two or more replaceable brush heads for various cleaning purposes.

Another advantage of the invention is to provide a pool brush assembly which main brush body also function as a docking holder to carry at least two independent brushes which can be selectively detached to work independently and to assembled with the main brush body to work collaboratively to perform various specific cleaning functions.

Another advantage of the invention is to provide a pool brush assembly configured to allow the user to replace end brush head adapted for cleaning different areas of the pool, especially such as corners, gaps, steps, clearances, uneven surfaces, and areas with irregular shapes.

Another advantage of the invention is to provide a pool brush assembly configured to allow the user to detach the end brush head to work independently to clean corners, gaps, steps, clearances, uneven surfaces, and etc. as desired with a simple push and pull action.

Another advantage of the invention is to provide a pool brush assembly configured to allow the user to replace different brush head to connect to the each end of the main brush body of the pool brush assembly.

Another advantage of the invention is to provide a pool brush assembly configured to have two different types of brush heads at two ends of the main brush body as desired for different cleaning environments and/or purposes.

Additional advantages and features of the invention will become apparent from the description which follows, and may be realized by means of the instrumentalities and combinations particular point out in the appended claims.

According to the present invention, the foregoing and other objects and advantages are attained by a pool brush assembly, comprising:

- a main brush body comprising an elongated brush frame having a first end and a second end and a plurality of brush elements outwardly extended from a brushing side thereof; and
- a replaceable handle and brush head arrangement, comprising:
- a connecting dock provided between the first end and the second end;
- a handle frame detachably connected to the connecting dock for detachably connecting with a handle bar;
- at least one end connector configured at one of the first end and the second end of the main brush body; and
- at least one brush head configured to be detachably connected to the at least one end connector, wherein the at one brush head comprises a connector joint and a plurality of end brush elements outwardly extended therefrom.

In one embodiment, the connecting dock comprises an elongated housing, having a receiving chamber, forming a middle portion of the main brush body, and two or more connectors formed in the receiving chamber. The handle frame having an upper end configured for connecting with the handle bar and a lower end configured to be connected with the two or more connectors of the housing of the connecting dock.

In one embodiment, the at least one end connector comprises a lock member configured to be detachably connected with the connector joint of the at least one brush head such that the end brush elements of the at least one brush head forms an end brush body of the main brush body.

In one embodiment, two end connectors are configured at the first end and the second end of the main brush body respectively and two brush heads are provided to detachably connect with lock members of the two end connectors respectively, such that the end brush elements of the two brush heads form two end brush bodies of the main brush body respectively.

In one embodiment, the pool brush assembly further comprises at least one brush head handle configured to be detachably connected to the connector joint of the at least one brush head detached from the main brush body to form an independent pool brush.

In accordance with another aspect of the invention, the present invention comprises a method of enlarging brushing area of a pool brush, comprising steps of:

connecting a pair of end brush heads to two ends of a main brush body; and combining end brush elements of the two end brush heads with the brush elements of the main brush body to form two end brush bodies of the main brush body.

Still further objects and advantages will become apparent from a consideration of the ensuing description and drawings.

These and other objectives, features, and advantages of the present invention will become apparent from the following detailed description, the accompanying drawings, and the appended claims.

DETAILED DESCRIPTION OF THE PREFERRED EMBODIMENT

The following description is disclosed to enable any person skilled in the art to make and use the present invention. Preferred embodiments are provided in the following description only as examples and modifications will be apparent to those skilled in the art. The general principles defined in the following description would be applied to other embodiments, alternatives, modifications, equivalents, and applications without departing from the spirit and scope of the present invention.

Figure 1:
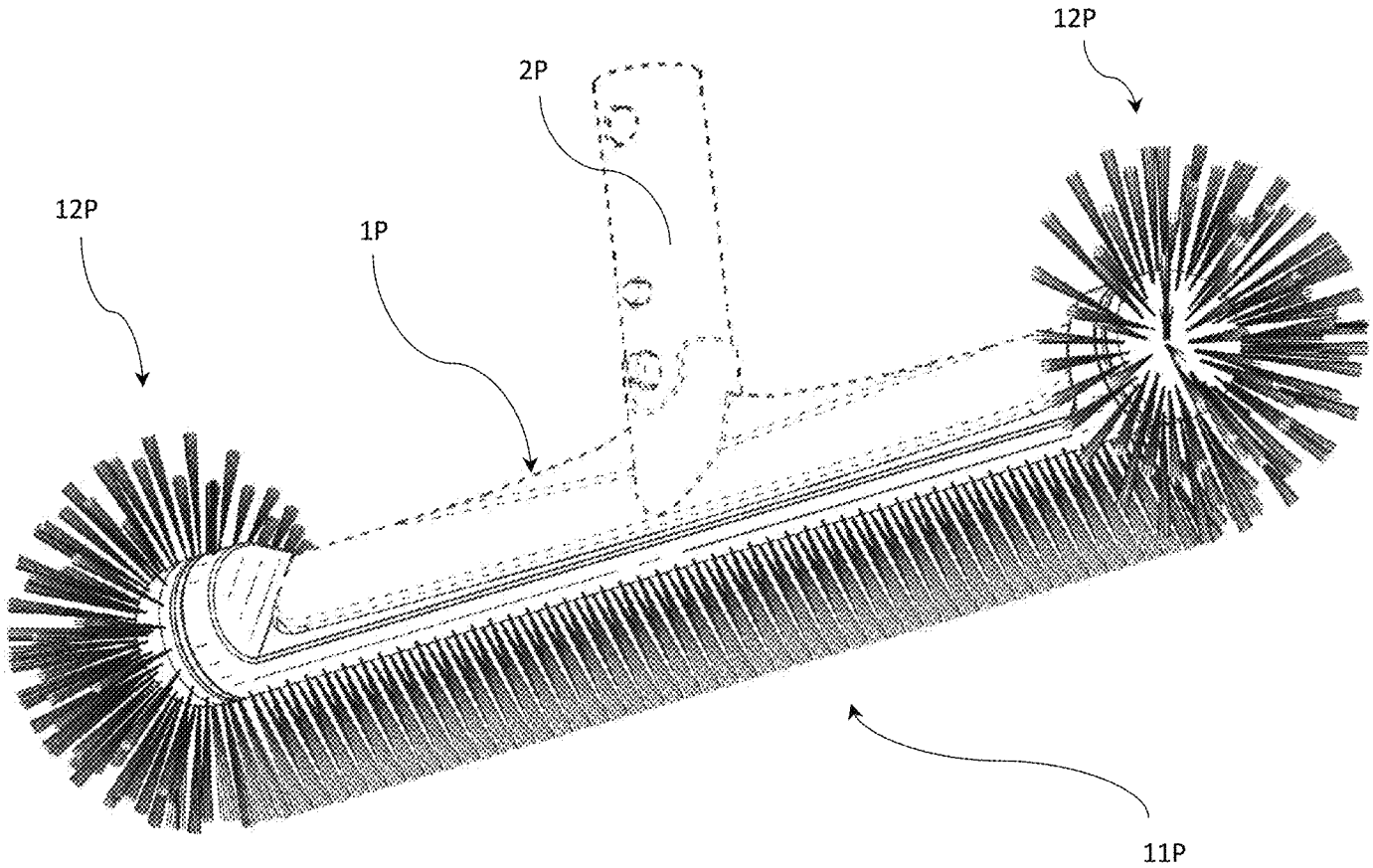
FIG. 1 PRIOR ART
FIG. 1 is a perspective view of a conventional pool brush.
Figure 2A:
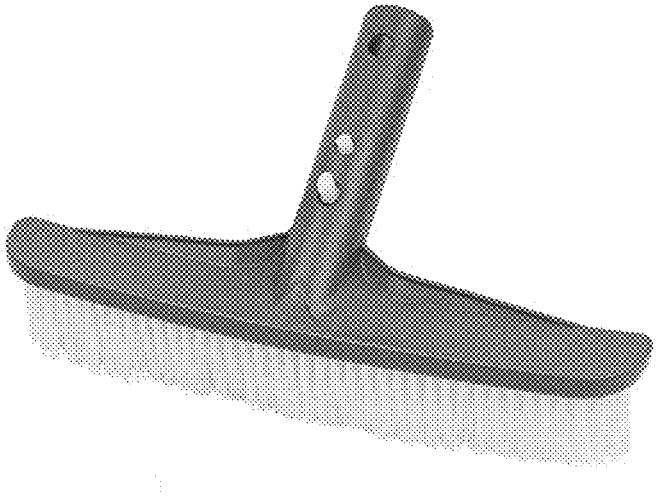
FIG. 2A PRIOR ART
FIG. 2A is a perspective view of another conventional pool brush.
Figure 2B:
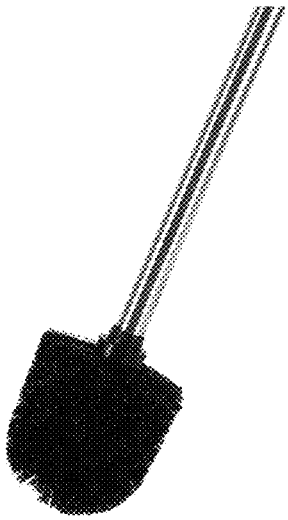
FIG. 2B PRIOR ART
FIG. 2B is a perspective view of a conventional round head pool brush.
Figure 3:
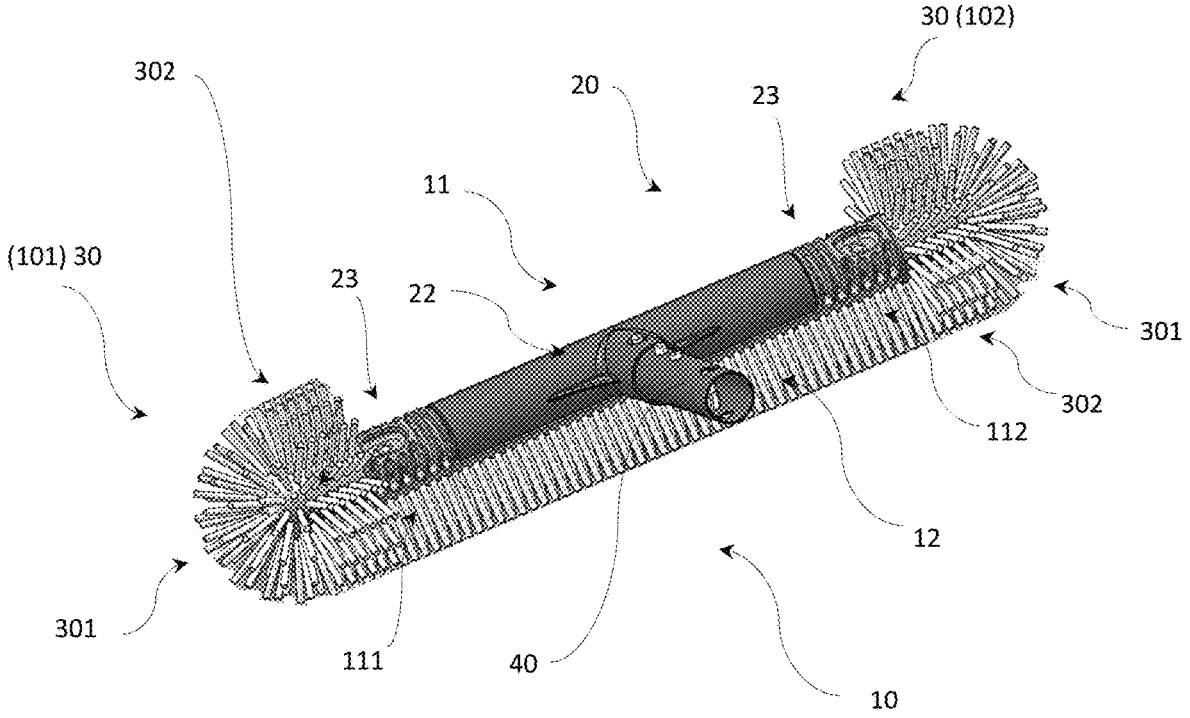
FIG. 3 is a perspective view of a pool brush assembly according to a preferred embodiment of the present invention.
Figure 4:
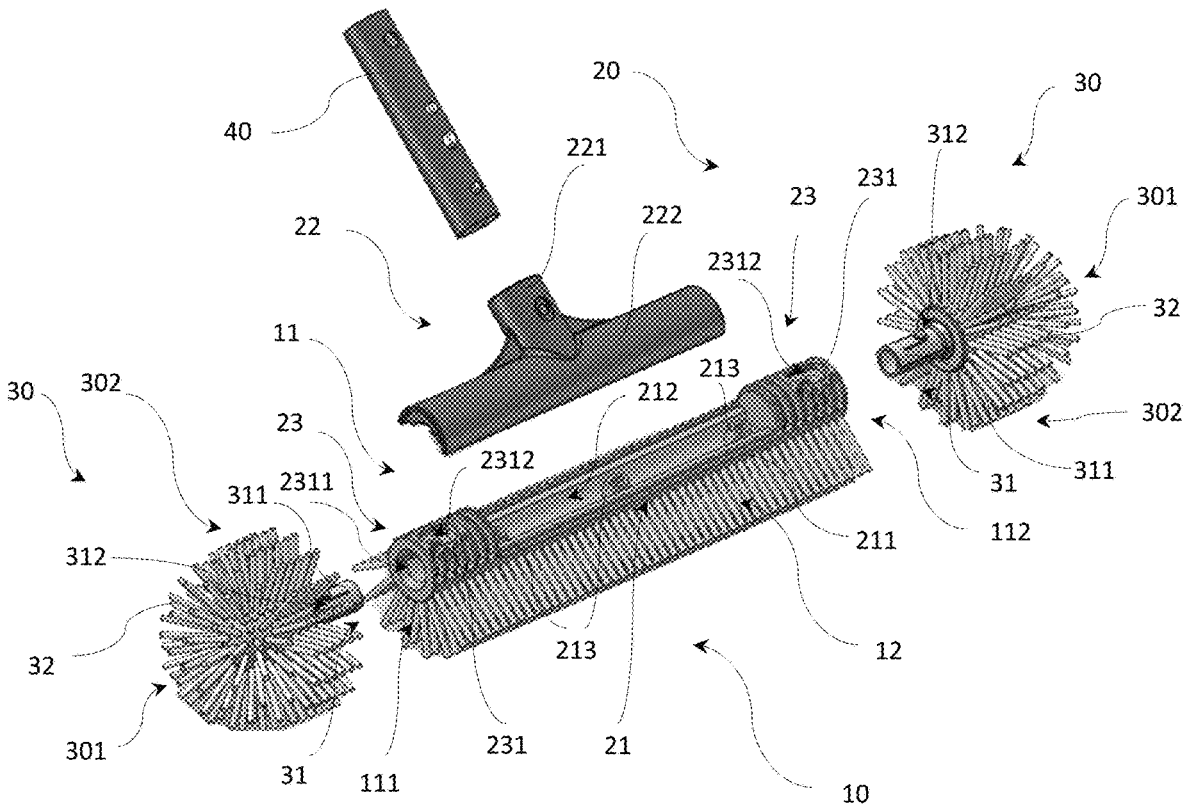
FIG. 4 is an exploded perspective view of the pool brush assembly according to the above preferred embodiment of the present invention.
Figure 5:
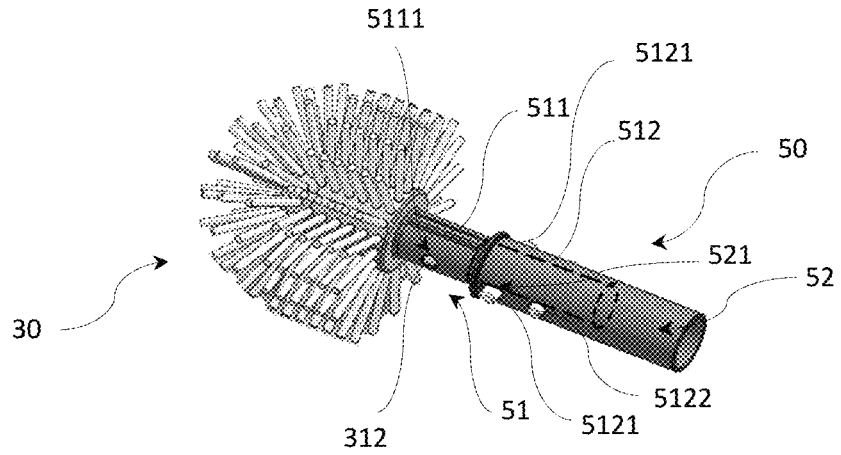
FIG. 5 is a perspective view of a brush head with a brush head handle according to the above preferred embodiment of the present invention.

Referring to FIG. 3 to FIG. 5, a pool brush assembly according to a preferred embodiment of the present invention is illustrated, a main brush body 10 and a replaceable hand and brush head arrangement 20.

The main brush body 10 comprises an elongated brush frame 11 having a first end 111 and a second end 112 and a plurality of brush elements 12 outwardly extended from a brushing side of the brush frame 11.

The replaceable handle and brush head arrangement 20 comprises a connecting dock 21 provided between the first end 111 and the second end 112 of the brush frame 11, a handle frame 22 detachably connected to the connecting dock 21 for detachably connecting with a handle bar 40, at least one end connector 23 configured at one of the first end 111 and the second end 112 of the main brush body 10, and at least one brush head 30 configured to be detachably connected to the at least one end connector 23.

Figure 6:
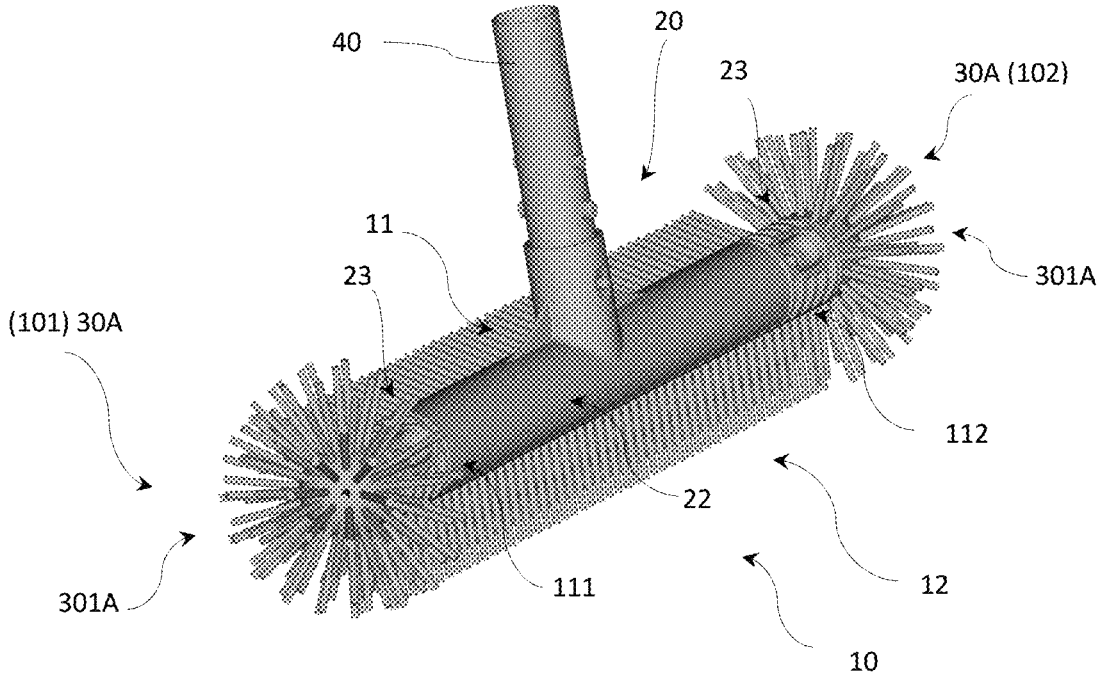
FIG. 6 is a perspective view of a first alternative mode of the brush head assembled with the main brush body according to the above preferred embodiment.

Referring to FIG. 4 to FIG. 6, the at one brush head 30 comprises a connector joint 31 and a plurality of end brush elements 32 outwardly extended therefrom. According to the preferred embodiment, two end connectors 23 are provided at the first end 111 and the second end 112 of the brush frame 11 of the main brush body 10 respectively and two brush heads 30 are provided to detachably connect with the two end connectors 23 respectively, such that the end brush elements 32 of the two brush heads 30 form two end brush bodies 101, 102 extended from the first end 111 and the second end 112 of the main brush body 10 respectively.

As shown in FIG. 4, each of the end connector 23 comprises a lock member 231 configured to be detachably connected with the connector joint 31 of the respective brush head 30 such that the end brush elements 32 of the brush head 30 forms the end brush body 101, 102 of the main brush body 10.

According to the preferred embodiment, as shown in FIG. 4, the connector joint 31 of each of the brush head 30 comprises a joint arm 311 coaxially extended from the brush head 30 and at least one resilient locking button 312 provided on the joint arm 311. The brush head 30 may have a round brush portion 301 and a circular brush portion 302, wherein the round brush portion 301 is formed in a semi-spherical shape at one end of the brush head 30 and the circular brush portion 302 is formed circularly between the round brush portion 301 and the connector joint 31. The end brush elements 32 are embodied as bristle bars evenly and spacedly extended outwards, wherein the end brush elements 32 of the round brush portion 301 are extended outwardly and radially and the end brush elements 32 of the circular brush portion 302 are extended outwardly and circularly.

Correspondingly, the lock member 231 of each of the end connectors 23 of main brush body 20 is a tubular body having a circular receiving socket 2311 and at least one locking hole 2312 formed in the lock member 231 and extended from the receiving socket to outside radially. To connect the brush head 30 to the main brush body 20, the joint arm 311 of the connector joint 31 of the brush head 30 is fittingly inserted into the receiving socket 2311 until the resilient locking button 312 is clicked and locked in the locking hole 2312, such that the brush head 30 is locked and connected with the end connector 23 of the main brush body 20. To detach the brush head 30 from the main brush body 20, simply push in the resilient locking button 312 towards the receiving socket 2311 until it is moved inwards from the locking hole 2312 to release the locking of the lock member 231 and the end connector 23. Then, the brush head 30 is able to be pulled out from the lock member 231 and detached from the main brush body 20.

It is appreciated that the diameter of the circular joint arm 311 is made fitting with the diameter of the tubular receiving socket 2311 of the lock member 231, such that when the elongated joint arm 311 is fittingly inserted into the receiving socket 2311, the joint arm 311 and the lock member 231 form an interconnecting configuration that not only rigidly connected the brush head 30 to the main brush body 20, but also the walls of the joint arm 311 and the lock member 231 substantially thicken and strengthen the first or second end 111, 112 of the brush frame 11 while securely connecting the two brush heads 30 with the main brush body 20 to form the pool brush assembly of the present invention.

Referring to the FIG. 5 of the drawings, the detached brush head 30 can be worked as an independent round pool brush, wherein the pool brush assembly according to the preferred embodiment of the present invention further comprises at least one elongated brush head handle 50 configured to be detachably connected to the connector joint 31 of the brush head 30. The brush head handle 50 comprises a handle connector 51 and an elongated bar 52, wherein the handle connector 51 is divided into a first connector tube 511 and a second connector tube 512 and comprises a stopper ring 513 formed between the first and second connector tubes 511, 512. The first connector tube 511 has a locking hole 5111 therein and is configured and sized to receive the joint arm 311 of the connector joint 31 of the brush head 30 inserted therein until the stopper ring 513 reaches an end of the bar 52 and the locking button 312 is protruded into the locking hole 5111 to lock the handle connector 51 to the brush head 30. To release the locking between the handle connector 51 and the brush head 30, simply push in the locking button 312 to inwardly move away from the locking hole 5111.

The second connector tube 512 of the handle connector 51 also comprises a pair of resilient locker buttons 5121 and a release button 5122 thereon. The bar 52 also has a predetermined length and a tubular end having a pair of locker holes 521 therein. Accordingly, the bar 52 is capable of connecting with the brush head 30 to function as a handle by inserting the second end tube 512 of the handle connector 51 into the tubular end of the bar 52 until the pair of locker buttons 5121 extended in the pair of locker holes 521 to lock the bar 52 in position. When the release button 5122 is pushed down to drive the pair of locker buttons 5121 downwards to move away from the pair of locker holes 521, the bar 52 can be detached from the handle connector 51 and the brush head 30 connected with the handle connector 51.

According to the preferred embodiment of the present invention, as shown in FIG. 4, the connecting dock 21 comprises an elongated housing 211, having a receiving chamber 212, forming a middle portion of the main brush body, and two or more connectors 213 formed in the receiving chamber 212. The handle frame 22 having an upper end 221 configured for connecting with the handle bar 40 and a lower end 222 configured to be connected with the two or more connectors 213 of the housing 211 of the connecting dock 21. The upper end 221 is preferred to have a predetermined inclined angle with the end 222 so that the handle bar 40 connected to the upper end 211 is configured to have a desired angle with the main brush body 10. The pool brush assembly of the present invention may include various handle frames 22 each having the upper end 221 having different inclined angle with the lower end 222 so as to allow the user to select the desired inclined angle of the handle bar 40 with respect to the main brush body 10.

Referring to FIG. 6, a first alternative mode of the brush head 30A is illustrated, wherein two brush heads 30A, which only has the round brush portion 301A without the circular brush portion 302 as illustrated in FIG. 3 to FIG. 5, are connected with the main brush body 10.

Figure 7:
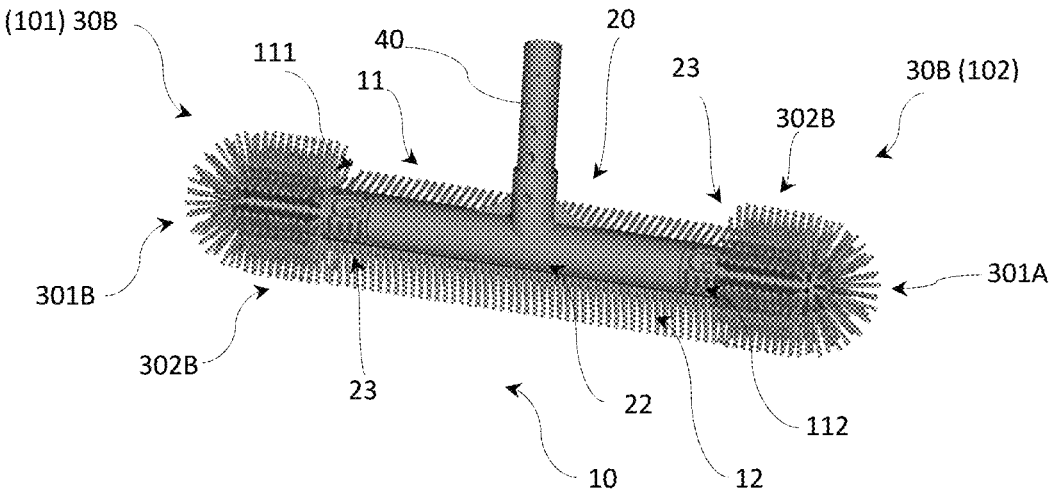
FIG. 7 is a perspective view of a second alternative mode of the brush head assembled with the main brush body according to the above preferred embodiment.
Figure 8:
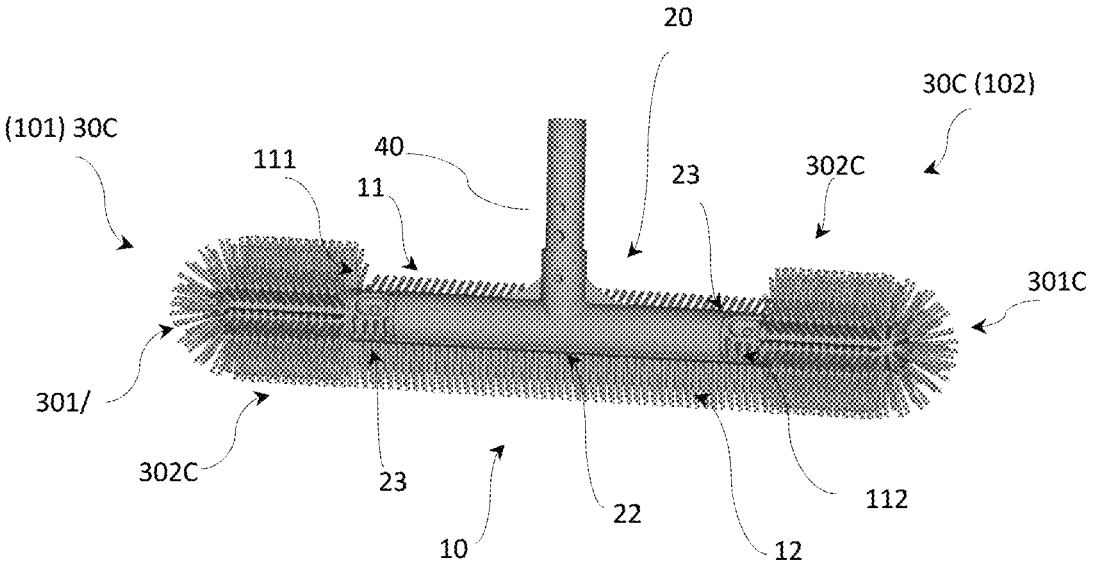
FIG. 8 is a perspective view of a third alternative mode of the brush head assembled with the main brush body according to the above preferred embodiment.

Referring to FIG. 7, a second alternative mode of the brush head 30B is illustrated, wherein two brush heads 30B, each of which also has the round brush portion 301A and the circular brush portion 302B having a longer length so as to provide a longer brush area, are connected with the main brush body 10. Referring to FIG. 8, a third alternative mode of the brush head 30C is illustrated, wherein two brush heads 30C, each of which also has the round brush portion 301C and the circular brush portion 302C having a length longer than the brush head 30B of the above second alternative mode so as to provide an extended brush area, are connected with the main brush body 10.

Figure 9:
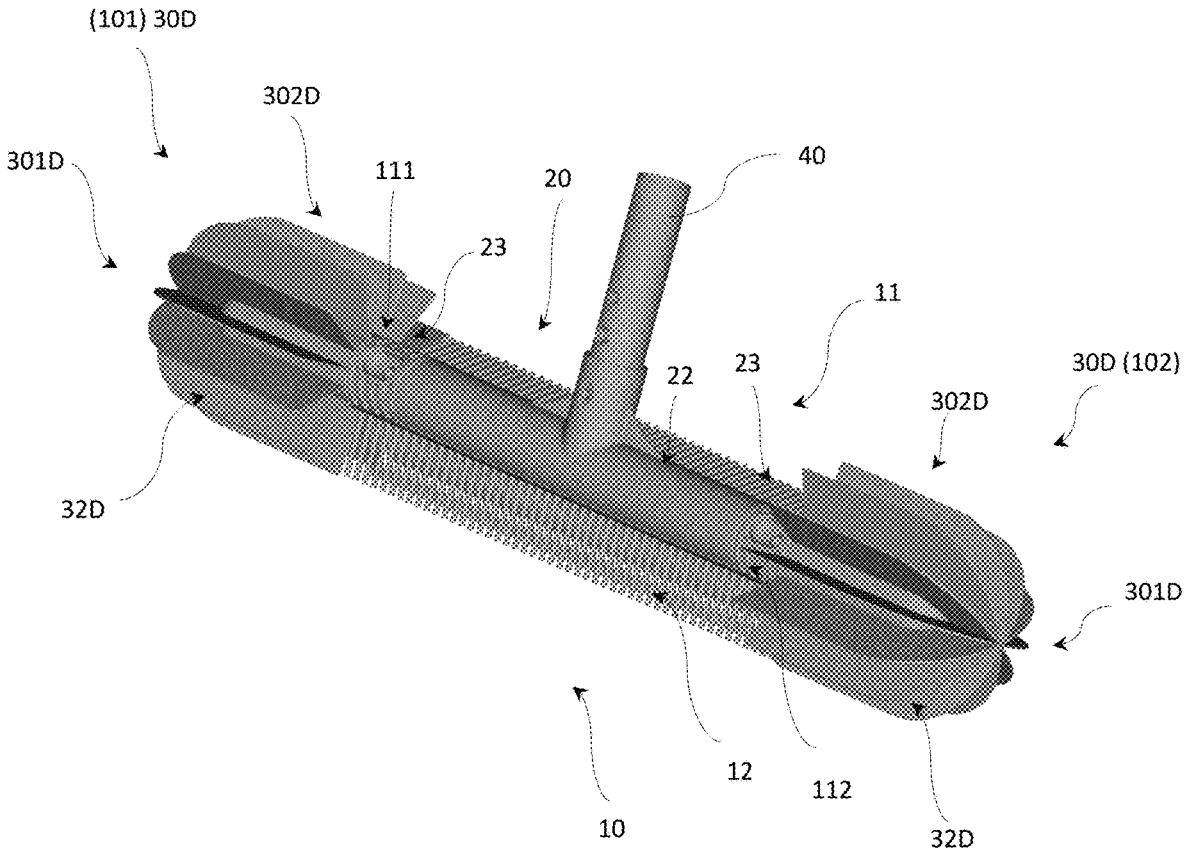
FIG. 9 is a perspective view of a fourth alternative mode of the brush head assembled with the main brush body according to the above preferred embodiment.

Referring to FIG. 9, a fourth alternative mode of the brush head 30D is illustrated, wherein two brush heads 30D are connected with the main brush body 10 as shown in FIG. 3 to FIG. 5. Each of the brush head 30D comprises a plurality of end brush elements 32D which are brushing blades outwardly and radially extended in a spaced manner to form the round brush portion 301D and the circular brush portion 302D. Accordingly, it is appreciated that the shape and form of the brush element 32-32D can be modified in order to adapt various working environments to form different kinds of brush head 30 configured to be connected to the main brush body 10. Therefore, the pool brush assembly according to the present invention may comprises multiple brush heads 30 having different lengths and brush elements to assemble with the main brush body 10 for different cleaning purposes and environments, i.e. the brush head 30 connected to the main brush body 10 is replaceable, while each of the brush heads 30 can be worked independently to form an independent pool brush with the bar 50 connected thereto.

By means of the pool brush assembly of the present invention as disclosed above, a method of enlarging brushing area of a pool brush is provided, wherein the method comprises steps of:

connecting the pair of end brush heads 30-30D to the first end 111 and second end 112 of the main brush body 10 respectively; and combining the end brush elements 32, 32D of the two end brush heads 30-30D with the brush elements 12 of the main brush body 10 to form two end brush bodies 101, 102 of the main brush body 10.

One skilled in the art will understand that the embodiment of the present invention as shown in the drawings and described above is exemplary only and not intended to be limiting.

It will thus be seen that the objects of the present invention have been fully and effectively accomplished. The embodiments have been shown and described for the purposes of illustrating the functional and structural principles of the present invention and is subject to change without departure from such principles. Therefore, this invention includes all modifications encompassed within the spirit and scope of the following claims.

What is claimed is:

1. A pool brush assembly, comprising:

a main brush body comprising an elongated brush frame having a first end and a second end and a plurality of brush elements outwardly extended from a brushing side thereof;

at least one brush head comprising a plurality of end brush elements radially and outwardly extended therearound;

at least one replaceable arrangement, comprising:

a connector joint, coaxially formed at one end of the at least one brush head, comprising a joint arm coaxially extended from the at least one brush head and at least one resilient locking button provided on the joint arm; and at least one end connector configured at one of the first end and the second end of the brush frame of the main brush body, wherein the at least one end connector comprises a lock member configured to be detachably connected with the connector joint of the at least one brush head, wherein the lock member is a tubular body having a circular receiving socket and at least one locking hole formed in the lock member and extended from the receiving socket to outside radially, such that the joint arm of the connector joint of the at least one brush head is fittingly inserted into the receiving socket until the resilient locking button is clicked and locked in the locking hole, so as to coaxially lock and connect the at least one brush head with the main brush body, and that the at least one brush head is able to be detached from the main brush body by pushing in the resilient locking button towards the receiving socket until the resilient locking button is moved inwards from the locking hole to release the locking of the lock member and the end connector; and at least one elongated brush head handle configured to be detachably connected to the connector joint of the brush head, wherein the brush head handle comprises a handle connector and an elongated bar, wherein the handle connector is divided into a first connector tube and a second connector tube and comprises a stopper ring formed between the first and second connector tubes, wherein the first connector tube has a locking hole therein and is configured and sized to receive the joint arm of the connector joint of the brush head inserted therein until the stopper ring reaches an end of the bar and the locking button is protruded into the locking hole to lock the handle connector to the brush head.

2. The pool brush assembly, as recited in claim 1, wherein the second connector tube of the handle connector also comprises a pair of resilient locker buttons and a release button thereon, wherein the bar has a predetermined length and a tubular end having a pair of locker holes therein, such that the bar is capable of connecting with the brush head to function as a handle by inserting the second end tube of the handle connector into the tubular end of the bar until the pair of locker buttons extended in the pair of locker holes to lock the bar in position.

3. The pool brush assembly, as recited in claim 2, further comprising a handle bar, wherein the replacement arrangement further comprises a connecting dock provided between the first end and the second end of the brush frame, a handle frame detachably connected to the connecting dock for detachably connecting with the handle bar, wherein the connecting dock comprises an elongated housing, having a receiving chamber, forming a middle portion of the main brush body, and two or more connectors formed in the receiving chamber, wherein the handle frame has an upper end configured to connect with the handle bar and a lower end configured to be connected with the two or more connectors of the housing of the connecting dock, wherein the upper end has a predetermined inclined angle with the end so that the handle bar connected to the upper end is configured to have a desired angle with the main brush body.

4. The pool brush assembly, as recited in claim 3, wherein the replacement arrangement further comprises at least one second handle frame for selectively replacing the handle frame and connecting to the connecting dock of the brush frame, wherein an upper end of the at least one second handle frame has a second inclined angle with a lower end thereof, different to the inclined angle of the handle frame.

5. The pool brush assembly, as recited in claim 4, wherein the at least one brush head comprises a plurality of end brush elements which are brushing blades outwardly and radially extended in a spaced manner to form a round brush portion and a circular brush portion.

6. A pool brush assembly, comprising:

a main brush body comprising an elongated brush frame having a first end and a second end and a plurality of brush elements outwardly extended from a brushing side thereof;

at least one brush head comprising a plurality of end brush elements radially and outwardly extended therearound, wherein the at least one brush head has a round brush portion formed in a semi-spherical shape at one end of the brush head and a circular brush portion formed circularly between the round brush portion and the connector joint;

at least one replaceable arrangement, comprising:

a connector joint, coaxially formed at one end of the at least one brush head, comprising a joint arm coaxially extended from the at least one brush head and at least one resilient locking button provided on the joint arm; and at least one end connector configured at one of the first end and the second end of the brush frame of the main brush body, wherein the at least one end connector comprises a lock member configured to be detachably connected with the connector joint of the at least one brush head, wherein the lock member is a tubular body having a circular receiving socket and at least one locking hole formed in the lock member and extended from the receiving socket to outside radially, such that the joint arm of the connector joint of the at least one brush head is fittingly inserted into the receiving socket until the resilient locking button is clicked and locked in the locking hole, so as to coaxially lock and connect the at least one brush head with the main brush body, and that the at least one brush head is able to be detached from the main brush body by pushing in the resilient locking button towards the receiving socket until the resilient locking button is moved inwards from the locking hole to release the locking of the lock member and the end connector, wherein a diameter of the joint arm is fitting with a diameter of the receiving socket of the lock member for the joint arm fittingly inserting into the receiving socket to form an interconnecting configuration of the joint arm and the lock member while walls of the joint arm and the lock member thicken and strengthen the one of the first end and second end of the brush frame; and at least one elongated brush head handle configured to be detachably connected to the connector joint of the brush head, wherein the brush head handle comprises a handle connector and an elongated bar, wherein the handle connector is divided into a first connector tube and a second connector tube and comprises a stopper ring formed between the first and second connector tubes, wherein the first connector tube has a locking hole therein and is configured and sized to receive the joint arm of the connector joint of the brush head inserted therein until the stopper ring reaches an end of the bar and the locking button is protruded into the locking hole to lock the handle connector to the brush head.

7. The pool brush assembly, as recited in claim 6, wherein the second connector tube of the handle connector also comprises a pair of resilient locker buttons and a release button thereon, wherein the bar has a predetermined length and a tubular end having a pair of locker holes therein, such that the bar is capable of connecting with the brush head to function as a handle by inserting the second end tube of the handle connector into the tubular end of the bar until the pair of locker buttons extended in the pair of locker holes to lock the bar in position.

8. The pool brush assembly, as recited in claim 7, wherein the at least one brush head comprises a plurality of end brush elements which are brushing blades outwardly and radially extended in a spaced manner to form the round brush portion and the circular brush portion.

9. A pool brush assembly, comprising:

a handle bar;

a main brush body comprising an elongated brush frame having a first end and a second end and a plurality of brush elements outwardly extended from a brushing side thereof;

at least one brush head comprising a plurality of end brush elements radially and outwardly extended therearound; and at least one replaceable arrangement, comprising:

a connector joint, coaxially formed at one end of the at least one brush head, comprising a joint arm coaxially extended from the at least one brush head and at least one resilient locking button provided on the joint arm;

at least one end connector configured at one of the first end and the second end of the brush frame of the main brush body, wherein the at least one end connector comprises a lock member configured to be detachably connected with the connector joint of the at least one brush head, wherein the lock member is a tubular body having a circular receiving socket and at least one locking hole formed in the lock member and extended from the receiving socket to outside radially, such that the joint arm of the connector joint of the at least one brush head is fittingly inserted into the receiving socket until the resilient locking button is clicked and locked in the locking hole, so as to coaxially lock and connect the at least one brush head with the main brush body, and that the at least one brush head is able to be detached from the main brush body by pushing in the resilient locking button towards the receiving socket until the resilient locking button is moved inwards from the locking hole to release the locking of the lock member and the end connector; and a connecting dock provided between the first end and the second end of the brush frame, a handle frame detachably connected to the connecting dock for detachably connecting with the handle bar, wherein the connecting dock comprises an elongated housing, having a receiving chamber, forming a middle portion of the main brush body, and two or more connectors formed in the receiving chamber, wherein the handle frame has an upper end configured to connect with the handle bar and a lower end configured to be connected with the two or more connectors of the housing of the connecting dock, wherein the upper end has a predetermined inclined angle with the end so that the handle bar connected to the upper end is configured to have a desired angle with the main brush body.

10. The pool brush assembly, as recited in claim 9, wherein the replacement arrangement further comprises at least one second handle frame for selectively replacing the handle frame and connecting to the connecting dock of the brush frame, wherein an upper end of the at least one second handle frame has a second inclined angle with a lower end thereof, different to the inclined angle of the handle frame.

11. A pool brush assembly, comprising:

a handle bar;

a main brush body comprising an elongated brush frame having a first end and a second end and a plurality of brush elements outwardly extended from a brushing side thereof;

at least one brush head comprising a plurality of end brush elements radially and outwardly extended therearound, wherein the at least one brush head has a round brush portion formed in a semi-spherical shape at one end of the brush head and a circular brush portion formed circularly between the round brush portion and the connector joint; and at least one replaceable arrangement, comprising:

a connector joint, coaxially formed at one end of the at least one brush head, comprising a joint arm coaxially extended from the at least one brush head and at least one resilient locking button provided on the joint arm;

at least one end connector configured at one of the first end and the second end of the brush frame of the main brush body, wherein the at least one end connector comprises a lock member configured to be detachably connected with the connector joint of the at least one brush head, wherein the lock member is a tubular body having a circular receiving socket and at least one locking hole formed in the lock member and extended from the receiving socket to outside radially, such that the joint arm of the connector joint of the at least one brush head is fittingly inserted into the receiving socket until the resilient locking button is clicked and locked in the locking hole, so as to coaxially lock and connect the at least one brush head with the main brush body, and that the at least one brush head is able to be detached from the main brush body by pushing in the resilient locking button towards the receiving socket until the resilient locking button is moved inwards from the locking hole to release the locking of the lock member and the end connector; and a connecting dock provided between the first end and the second end of the brush frame, a handle frame detachably connected to the connecting dock for detachably connecting with the handle bar, wherein the connecting dock comprises an elongated housing, having a receiving chamber, forming a middle portion of the main brush body, and two or more connectors formed in the receiving chamber, wherein the handle frame has an upper end configured to connect with the handle bar and a lower end configured to be connected with the two or more connectors of the housing of the connecting dock, wherein the upper end has a predetermined inclined angle with the end so that the handle bar connected to the upper end is configured to have a desired angle with the main brush body.

12. The pool brush assembly, as recited in claim 11, wherein the replacement arrangement further comprises at least one second handle frame for selectively replacing the handle frame and connecting to the connecting dock of the brush frame, wherein an upper end of the at least one second handle frame has a second inclined angle with a lower end thereof, different to the inclined angle of the handle frame.

13. The pool brush assembly, as recited in claim 12, wherein the at least one brush head comprises a plurality of end brush elements which are brushing blades outwardly and radially extended in a spaced manner to form the round brush portion and the circular brush portion.

14. The pool brush assembly, as recited in claim 11, wherein the at least one brush head comprises a plurality of end brush elements which are brushing blades outwardly and radially extended in a spaced manner to form the round brush portion and the circular brush portion.

15. A pool brush assembly, comprising:

a main brush body comprising an elongated brush frame having a first end and a second end and a plurality of brush elements outwardly extended from a brushing side thereof;

at least one brush head comprising a plurality of end brush elements radially and outwardly extended therearound, wherein the at least one brush head has a round brush portion formed in a semi-spherical shape at one end of the brush head and a circular brush portion formed circularly between the round brush portion and the connector joint, wherein the plurality of end brush elements are brushing blades outwardly and radially extended in a spaced manner to form the round brush portion and the circular brush portion; and at least one replaceable arrangement, comprising:

a connector joint, coaxially formed at one end of the at least one brush head, comprising a joint arm coaxially extended from the at least one brush head and at least one resilient locking button provided on the joint arm; and at least one end connector configured at one of the first end and the second end of the brush frame of the main brush body, wherein the at least one end connector comprises a lock member configured to be detachably connected with the connector joint of the at least one brush head, wherein the lock member is a tubular body having a circular receiving socket and at least one locking hole formed in the lock member and extended from the receiving socket to outside radially, such that the joint arm of the connector joint of the at least one brush head is fittingly inserted into the receiving socket until the resilient locking button is clicked and locked in the locking hole, so as to coaxially lock and connect the at least one brush head with the main brush body, and that the at least one brush head is able to be detached from the main brush body by pushing in the resilient locking button towards the receiving socket until the resilient locking button is moved inwards from the locking hole to release the locking of the lock member and the end connector.

16. The pool brush assembly, as recited in claim 15, wherein a diameter of the joint arm is fitting with a diameter of the receiving socket of the lock member for the joint arm fittingly inserting into the receiving socket to form an interconnecting configuration of the joint arm and the lock member while walls of the joint arm and the lock member thicken and strengthen the one of the first end and second end of the brush frame.

* * * * *